US008757323B2

(12) United States Patent
Sutton et al.

(10) Patent No.: US 8,757,323 B2
(45) Date of Patent: Jun. 24, 2014

(54) PORTABLE SAWHORSE WORKSTATION

(75) Inventors: Jacob Sutton, Auburn, AL (US); Tsailu Liu, Auburn, AL (US); Paul W. Holley, Auburn, AL (US)

(73) Assignee: Auburn University, Auburn, AL (US)

( * ) Notice: Subject to any disclaimer, the term of this patent is extended or adjusted under 35 U.S.C. 154(b) by 137 days.

(21) Appl. No.: 12/959,536

(22) Filed: Dec. 3, 2010

(65) Prior Publication Data

US 2011/0233000 A1 Sep. 29, 2011

Related U.S. Application Data

(60) Provisional application No. 61/266,413, filed on Dec. 3, 2009.

(51) Int. Cl.
*B25H 1/06* (2006.01)
*E04G 1/32* (2006.01)

(52) U.S. Cl.
CPC ... *B25H 1/06* (2013.01); *E04G 1/32* (2013.01)
USPC ..... 182/186.5; 182/181.1; 182/183.1; 182/185.1; 182/186.3

(58) Field of Classification Search
USPC ..... 182/181.1, 183.1, 185.1, 186.1, 186.3, 182/186.4, 186.5
See application file for complete search history.

(56) References Cited

U.S. PATENT DOCUMENTS 2,698,771 A * 1/1955 O'Rourk ..... 182/151
2,891,819 A * 6/1959 Jackson ..... 182/113
3,830,340 A * 8/1974 Schaffel ..... 182/226
3,978,943 A * 9/1976 Greenman et al. ..... 182/155
4,062,423 A * 12/1977 Armbruster ..... 182/129
4,134,473 A * 1/1979 Prior ..... 182/92
4,228,871 A * 10/1980 Koffski ..... 182/182.4
4,238,001 A * 12/1980 Alexander ..... 182/153
4,296,835 A * 10/1981 Koffski ..... 182/182.4
4,298,095 A * 11/1981 Jackson et al. ..... 182/182.4
4,308,934 A * 1/1982 Jackson et al. ..... 182/182.4
4,502,565 A * 3/1985 Koffski ..... 182/182.4
4,836,333 A * 6/1989 Twigger ..... 182/181.1
5,092,427 A * 3/1992 MacMillan ..... 182/20
5,836,365 A * 11/1998 Derecktor ..... 144/287
5,878,839 A * 3/1999 Lin ..... 182/181.1
6,059,071 A * 5/2000 Appezzato ..... 182/181.1
6,123,173 A * 9/2000 Patros ..... 182/181.1
6,298,946 B1 * 10/2001 Yemini et al. ..... 182/153
7,140,409 B2 * 11/2006 Leberfinger et al. ..... 144/286.1
7,481,254 B2 * 1/2009 Welsh et al. ..... 144/286.1
7,814,947 B2 * 10/2010 Ayala et al. ..... 144/286.1
2004/0159493 A1 * 8/2004 Elliot ..... 182/181.1
2005/0194215 A1 * 9/2005 Radermacher ..... 182/181.1

* cited by examiner

*Primary Examiner* — Alvin Chin Shue
*Assistant Examiner* — Colleen M Chavchavadze
(74) *Attorney, Agent, or Firm* — Gardner Groff Greenwald & Villanueva, PC

(57) ABSTRACT

An improved sawhorse having an elongated body with a channel formed in an upper working surface thereof. The sawhorse also includes a ledger that is sized and shaped to be seated within the channel and a clamp that is operable to secure the ledger to the elongated body. The elongated body further includes a plurality of receptacles that are adapted to receive a corresponding plurality of support legs.

20 Claims, 4 Drawing Sheets

PORTABLE SAWHORSE WORKSTATION

CROSS-REFERENCE TO RELATED APPLICATION

This application claims the priority benefit of U.S. Provisional Patent Application Ser. No. 61/266,413, filed Dec. 3, 2009, which is incorporated herein by reference.

TECHNICAL FIELD

The present invention relates generally to the field of building construction and, in particular, to sawhorses and other workstations.

BACKGROUND

Sawhorses have been known and used in the construction and/or woodworking industries to support work pieces since at least as early as the 1800's. Traditional sawhorses are comprised of at least one horizontal beam or ledger spanning a pair of splayed legs that are positioned near the terminal ends of the ledger. Typically, the horizontal ledger includes a flat upper work surface for supporting a load. Optionally, sawhorses are known to include one or more braces between the legs to provide for additional support and stability. In the field, sawhorses are most commonly utilized in pairs, such that work pieces or scaffolds can be supported by the work surfaces of both sawhorses.

Despite the fact that such traditional sawhorses have been around for many years, there are still many drawbacks associated therewith. For example, on a typical job site, workers often must construct two or more sawhorses as supports for ripping/cutting the numerous pieces of lumber that are required for most building projects. However, when cutting lumber that is positioned over a working surface of a traditional sawhorse, a worker often cuts into the horizontal ledger of the underlying sawhorse. Subsequent cuts continue to damage the sawhorse(s) until the working surface becomes unstable and/or unlevel, which makes the continued use of that particular sawhorse undesirable and/or unsafe. Thus, once the horizontal ledger of such a sawhorse has been sufficiently damaged to dissuade further use, a worker is often required to construct an entirely new sawhorse to provide an adequate working surface. The assembly of one or more new sawhorses is both time consuming and wastes the worker's resources. Additionally, since traditional sawhorses are largely constructed from wood, they are quite heavy and are cumbersome. As a result, such sawhorses are not easily transported and are typically constructed on site.

Accordingly, it can be seen that needs exist for an improved sawhorse that is both portable and long-lasting. It is to the provision of these needs and others that the present invention is primarily directed.

SUMMARY

In example embodiments, the present invention relates to an improved sawhorse that solves many of the problems associated with known sawhorses. For example, the improved sawhorse of the present invention provides for a reusable body that can be used indefinitely in combination with interchangeable components, which can be replaced as needed. Additionally, the sawhorse body as described herein is preferably constructed of lightweight and rigid materials, which makes the body of the sawhorse easy to store and transport from location to location. As such, the present invention abates the current need to repeatedly construct new sawhorses at various building sites and/or when a component of a known sawhorse has been consumed.

In one aspect, the present invention is an improved sawhorse having an elongated body with a channel formed in an upper working surface thereof. The sawhorse also includes a ledger that is sized and shaped to be seated within the channel and a clamp that is operable to secure the ledger to the elongated body. The elongated body further includes a plurality of receptacles that are adapted to receive a corresponding plurality of support legs.

In another aspect the present invention is a sawhorse body having an elongated channel positioned along an upper working surface of the body, which is adapted to receive a removable and replaceable ledger therein. The sawhorse body also includes a plurality of receptacles positioned adjacent to one or more terminal ends of the sawhorse body. The receptacles each define a hollow cavity for receiving a corresponding plurality of support legs therein. Furthermore, the sawhorse body includes a clamp for securing the replaceable ledger thereto.

In still another aspect, the present invention includes a sawhorse having an elongated body with two receptacles stationed near a first terminal end of the body and two additional receptacles stationed near a second terminal end of the body. The elongated body further includes a channel formed in an upper working surface thereof and a replaceable ledger sized and shaped to be seated within the channel. Furthermore, the elongated body has four legs operable to be inserted within the receptacles, wherein one leg is inserted into a corresponding receptacle. Finally, the elongated body includes a fastener for selectively securing the replaceable ledger to the elongated body.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

Figure 1:
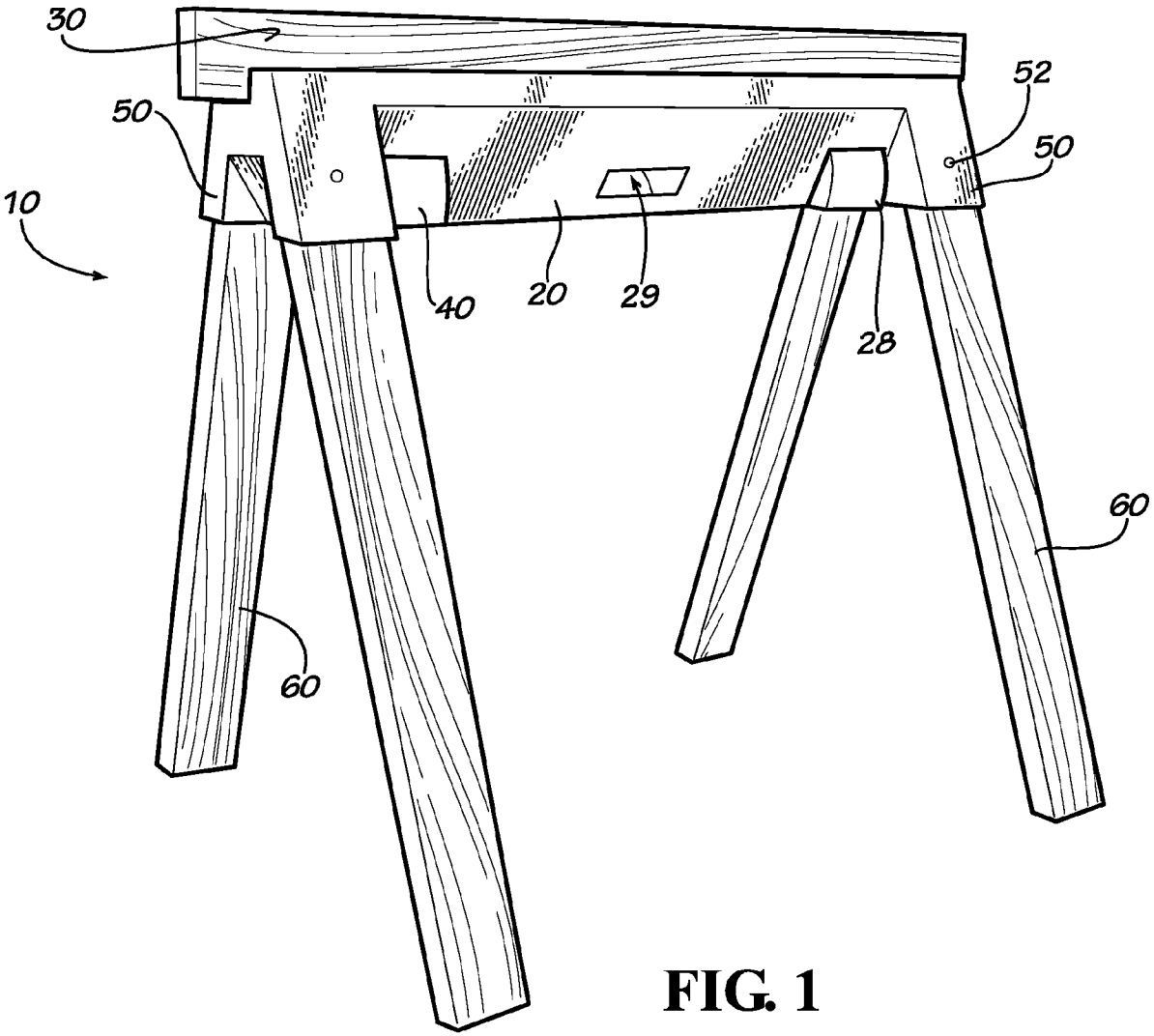
FIG. 1 is a perspective view of an improved sawhorse according to a first example embodiment of the present invention.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-5 depict an improved sawhorse 10 according to an example embodiment of the present invention. Generally, the improved sawhorse 10 includes a permanent (or semi-permanent) rigid and elongated body 20, an interchangeable ledger 30, and a clamp 40 for securing the interchangeable ledger to the body. Additionally, the body 20 includes one or more receptacles 50, and preferably four receptacles, for receiving removable and replaceable support legs 60 therein. As such, the improved sawhorse of the present invention provides for a reusable body that can be used indefinitely in combination with interchangeable components that can be replaced as needed.

Figure 2:
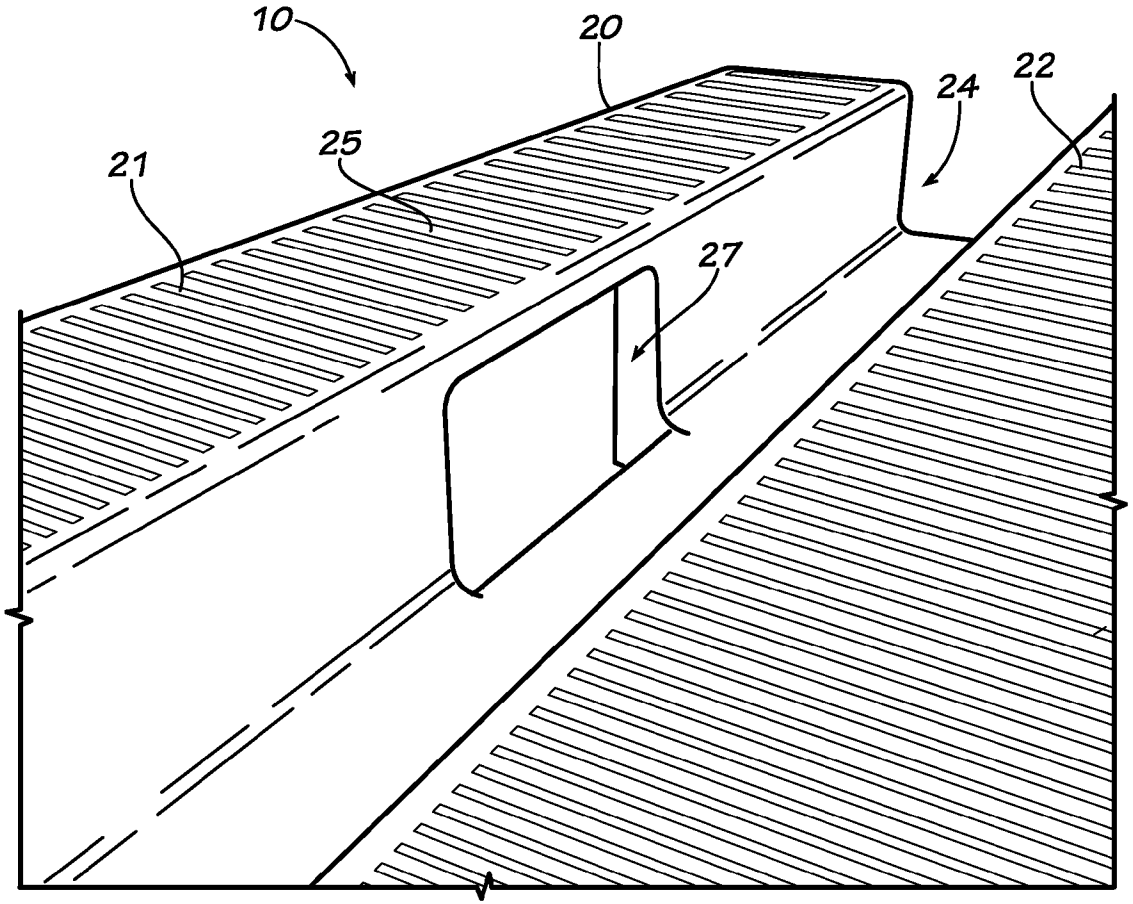
FIG. 2 is a close-up perspective view of the improved sawhorse of FIG. 1, showing the upper working surface thereof.

With particular reference now to FIGS. 1-2, it can be seen that the body 20 of the sawhorse 10 includes a pair of substantially parallel planar working surfaces 21, 22, which are separated by an elongated channel 24 that substantially extends along the length of the body 20. In example embodiments, working surfaces 21 and 22 include one or more rulers 25 that extend along the length of the surfaces. Alternative embodiments can include only one ruler 25 or can have no ruler as desired. The ruler(s) 25 can be listed in either English or Metric units or can include a combination of both units of measurement. The ruler 25 can be molded into the working surfaces 21, 22 or can be stamped, painted, or otherwise applied to the same. In commercial embodiments, the body 20 is formed from molded plastic because of its relative light weight coupled with its strength and rigidity. However, in alternate embodiments, the body 20 can be formed from other polymers, rubber, one or more metals, wood, other rigid materials, or can be formed from a combination of such. In those embodiments in which the body 20 is formed from molded plastic, the ruler is preferably molded into one or more of the working surfaces 21, 22.

The channel 24 is adapted to receive an interchangeable, replaceable and/or removable ledger or beam 30 therein, as best seen in FIG. 1. In commercial embodiments, the ledger 30 is a length of solid wood sized to fit within the width of the channel 24. For instance, in example embodiments, the channel 24 can be sized to accommodate standard lumber having a nominal thickness of two inches (cut down to approximately 1.5 inches), such as a standard two by four (2"×4"), two by six (2"×6"), etc. In other embodiments, the channel can accommodate wooden ledgers 30 having various dimensions. For example, a particular ledger 30 can be sized to extend within only a partial fraction of the channel 24 or can alternatively extend indefinitely beyond the length of the channel. In fact, it is anticipated that multiple sawhorse bodies can be linked together to support a ledger 30 that extends beyond the channel of a single body 30. Additionally, the channel 24 can be sized as desired to accommodate ledgers having a larger or smaller width than is commonly associated with dimensional lumber. Moreover, while the ledger is preferably formed from dimensional lumber, the ledger 30 can alternatively be constructed from sawdust, resin, wood flakes, recycled materials, or other materials as desired by a user.

To prevent the ledger 30 from sliding within the channel 24 and/or to minimize vibration of the ledger within the same, a clamp 40 is utilized to secure the ledger 30 to the sawhorse body 20. Alternatively, two or more clamps are used to secure the ledger 30 to the body 20. In commercial embodiments, the clamp 40 is a toggle clamp (the mechanism of which will be discussed below). In alternative embodiments, screw clamps, compression clamps, spring clamps, and/or other clamps as desired by a user can be employed to secure the ledger 30 to the sawhorse body 20. In other embodiments, other conventional fasteners can be utilized instead of one or more clamps to secure the same, such as screws, bolts/nuts, glue, epoxy, pins, nails, etc. The clamp 40 and/or other fastener(s) can be located in various locations on the sawhorse body 20 to secure the ledger 30 thereto. In still other alternative embodiments, the ledger 30 can be frictionally secured to the walls of the channel 24 to secure the same thereto.

Figure 3:
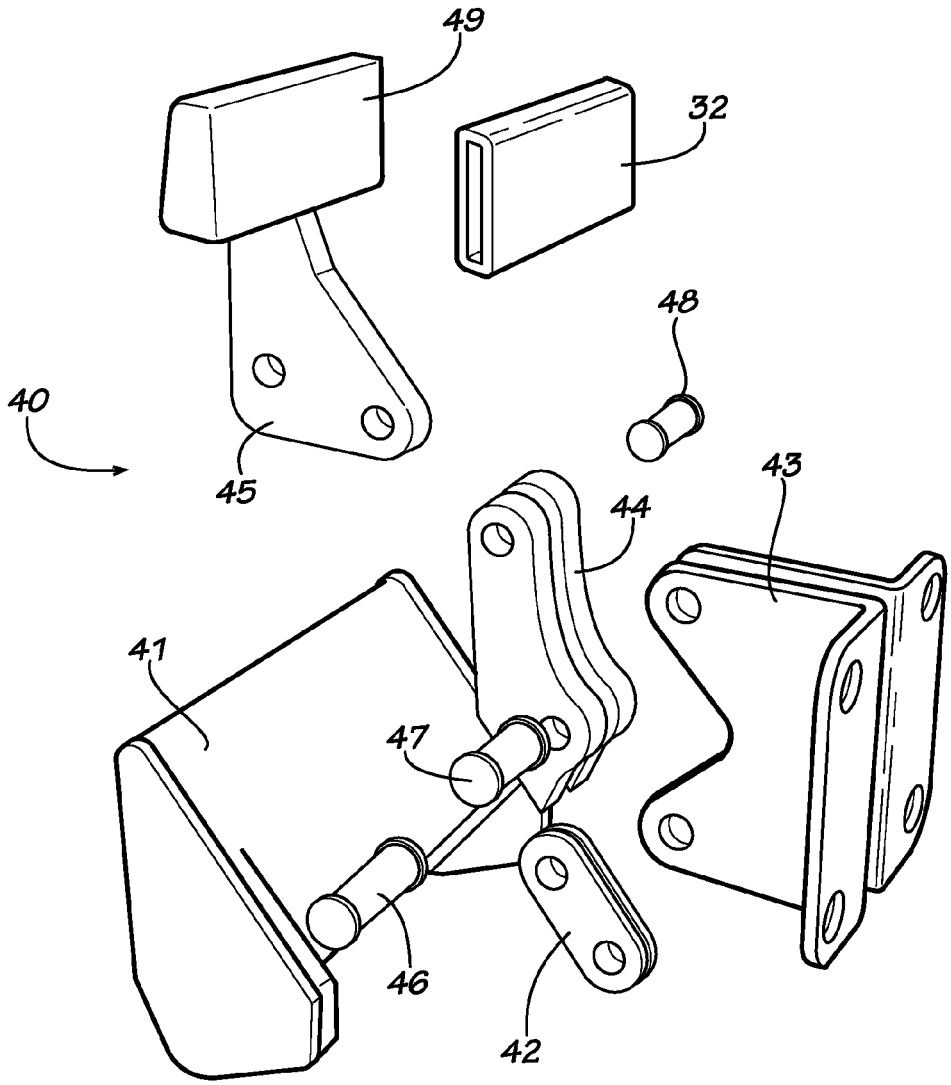
FIG. 3 is an exploded perspective view of an example clamp used in conjunction with an improved sawhorse according example embodiments of the present invention.

An example toggle clamp 40 as used in conjunction with commercial embodiments of the present invention is shown in FIG. 3. Generally, the clamp 40 includes a handle 41 that extends beyond an outer face of the sawhorse body 20 (as seen in FIG. 1) and is accessible to a user. In depicted embodiments, the handle 41 is connected to series of linkages 42-45 and pins 46-48, which are ultimately linked to a contact face 49. In operation, a user can depress the handle 41 to drive the contact face 49 through an opening 27 in the channel 24 of the sawhorse body 20 against an opposing contact face of the ledger 30. The force of the contact face 49 against the ledger 30 substantially secures the ledger 30 within the channel 24. The contact face 49 can optionally include a frictional pad 32 for directly engaging the ledger 30. In still other embodiments, the contact face 49 can include a toothed or spiked surface for better coupling the contact face to the ledger 30. To release the contact face 49 from the ledger 30, a user can lift up on the handle 41. While a specific toggle clamp 40 has been discussed and describe herein, in alternate embodiments, various arrangements of linkages, pins, springs, etc. can be linked together to form a similar toggle clamp.

As briefly mentioned above, the body 20 of the sawhorse 10 also includes a plurality of receptacles 50 that are adapted to receive corresponding support legs 60 therein. As seen in FIG. 1, it is preferred that the sawhorse 10 include four receptacles 50 positioned at or near the terminal ends of the body 20 and that extend away from the body at oblique angles. As such, preferred example embodiments of the present invention include receptacles 50 that form a "V" shape with the body 20 as seen in the drawing figures. Each receptacle 50 includes a hollow cavity or channel that is preferably sized and shaped to receive a standard-sized piece of solid lumber therein (such as a 2"×4"), but can also be sized and shaped to receive various other materials such as metal, plastic, rubber and/or composite lumber legs. Optionally, each receptacle 50 can include one or more pre-fabricated holes 52 for receiving a screw, bolt, or other conventional fastener to secure each leg 60 to a corresponding receptacle (best seen in FIG. 4). Alternatively, each leg 60 can be secured to a receptacle 50 with a releasable clamp or can be permanently affixed thereto if desired by a user. In example embodiments, the legs 60 can be the same length or each leg can be independently sized as desired. For example, when utilizing the sawhorse 10 of the present invention on level terrain, it would be anticipated that a user would utilize legs 60 having the same length to level the sawhorse. Conversely, should a user find himself/herself working on unlevel terrain, the one or more legs 60 can be easily sized and/or replaced to level the same.

Figure 4:
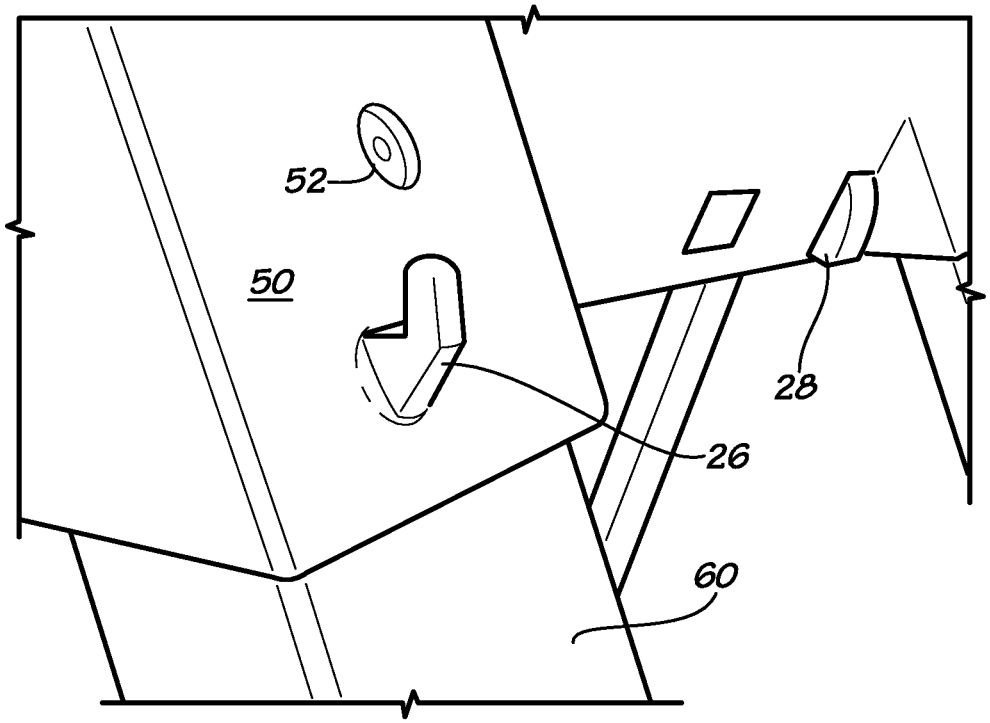
FIG. 4 is a close-up perspective view of the improved sawhorse of FIG. 1, showing a receptacle in more detail.
Figure 5:
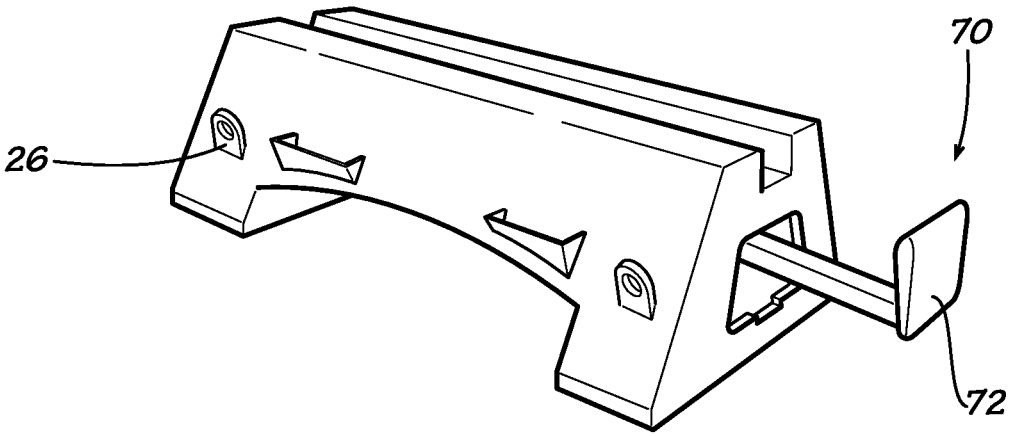
FIG. 5 is a perspective view of a sawhorse body according to another example embodiment of the present invention.

Example embodiments of the sawhorse 10 can also include various other features that greatly enhance a user's work experience when utilizing the same. For example, as shown in FIG. 4, the body 20 can include one or more hooks 26 for hanging various tools from the sawhorse 10, when the tool is not in use by a user. The body 20 can also include one or more containers 28 for storing nails, fasteners, tools, supplies, or other working implements. Additionally, commercial embodiments of the sawhorse 10 include a handle 29, positioned within the body 20 as depicted in FIG. 1. The handle 29 provides a convenient hand-hold for a user to carry the sawhorse 10 between locations. In still other example embodiments, the sawhorse body 20 can include one or more extendable rails or support arms 70 that extend from the terminal ends of the body and expand the length of the work surface to support larger work pieces, as seen in FIG. 5. In such embodiments, the support arms 70 can optionally rotate, and/or include rotatable tips 72 to vary the relative height of the support arms in relation to a work piece placed on top of the ledger 30.

In use, it has been found that the sawhorse 10 of the present invention is superior in many aspects when compared to traditional site-built sawhorses known in the prior art. For example, the sawhorse body 20 as described herein is preferably constructed of lightweight and rigid materials and permits the removal of the ledger 30 and/or legs 60, which makes the body 20 of the sawhorse easy to store and transport from location to location. Furthermore, once at a job site, a user need only obtain the desired amount of legs 60, seat them within the corresponding receptacles 50, insert a ledger 30 into the channel 24, and secure the same with the toggle clamp 40 (or other fastener)—instead of constructing an entire sawhorse each and every time one is needed at a different location as is typically required of a user when working with traditional sawhorses. Moreover, a user can make multiple cuts through the replaceable ledger 30 and simply replace the ledger when damage to the same renders it incapable or unsafe as a working surface.

While the invention has been described with reference to preferred and example embodiments, it will be understood by those skilled in the art that a variety of modifications, additions and deletions are within the scope of the invention, as defined by the following claims.

What is claimed is:

1. A sawhorse comprising:

an elongated body having two receptacles stationed near a first terminal end thereof and two additional receptacles stationed near a second terminal end thereof, the elongated body further including a channel formed in an upper surface thereof, the channel comprising first and second sidewalls extending in a lengthwise direction;

four legs operable to be inserted within said receptacles, wherein each leg is inserted into a respective receptacle;

a replaceable ledger sized and shaped to be seated within the channel with a support surface of the replaceable ledger projecting above the upper surface of the elongated body for supporting a work piece; and a fastener comprising a toggle clamp for selectively securing the replaceable ledger to the elongated body, a portion of the fastener operable through an opening in at least one of the first and second sidewalls to engage the replaceable ledger, wherein the replaceable ledger can be removed from the channel of the elongated body and replaced when damage renders it unsuitable as a working surface.

2. The sawhorse of claim 1, wherein the toggle clamp includes a contact face having a frictional pad coupled thereto.

3. The sawhorse of claim 1, wherein the toggle clamp includes a handle operable to engage a contact surface against the removable ledger.

4. The sawhorse of claim 1, wherein the replaceable ledger is formed from solid two-by dimensional lumber.

5. The sawhorse of claim 1, wherein the legs are formed from solid dimensional lumber.

6. The sawhorse of claim 3, wherein the handle is provided for manipulating the toggle clamp between a first position in which the contact surface is engaged with the ledger and a second position in which the contact surface is disengaged from the ledger.

7. The sawhorse of claim 3, wherein the contact surface includes a frictional contact face.

8. The sawhorse of claim 1, wherein the upper surface of the elongated body includes a ruler.

9. The sawhorse of claim 1, wherein the receptacles extend from the elongated body at oblique angles to form a "V" shape with the body.

10. The sawhorse body of claim 1, wherein the toggle clamp is operative transversely to the lengthwise direction to secure the replaceable ledger within the channel.

11. A sawhorse comprising:

an elongated body having two receptacles stationed near a first terminal end thereof and two additional receptacles stationed near a second terminal end thereof, the elongated body further including a channel formed in an upper surface thereof, the channel comprising first and second sidewalls extending in a lengthwise direction;

four legs operable to be inserted within said receptacles, wherein each leg is inserted into a respective receptacle;

a replaceable ledger sized and shaped to be seated within the channel with a support surface of the replaceable ledger projecting above the upper surface of the elongated body for supporting a work piece; and a fastener comprising a spring-biased clamp for selectively securing the replaceable ledger to the elongated body, a portion of the fastener operable through an opening in at least one of the first and second sidewalls to engage the replaceable ledger, wherein the replaceable ledger can be removed from the channel of the elongated body and replaced when damage renders it unsuitable as a working surface.

12. The sawhorse of claim 11, wherein the replaceable ledger is formed from solid two-by dimensional lumber.

13. The sawhorse of claim 11, wherein the legs are formed from solid dimensional lumber.

14. The sawhorse of claim 11, wherein the receptacles extend from the elongated body at oblique angles to form a "V" shape with the body.

15. The sawhorse of claim 11, wherein the spring-biased clamp includes a contact face having a frictional pad coupled thereto.

16. The sawhorse of claim 11, wherein the spring-biased clamp includes a handle operable to engage a contact surface against the removable ledger.

17. The sawhorse of claim 16, wherein the handle is provided for manipulating the spring-biased clamp between a first position in which the contact surface is engaged with the ledger and a second position in which the contact surface is disengaged from the ledger.

18. The sawhorse of claim 16, wherein the contact surface includes a frictional contact face.

19. The sawhorse of claim 11, wherein the upper surface of the elongated body includes a ruler.

20. The sawhorse body of claim 11, wherein the spring-biased clamp is operative transversely to the lengthwise direction to secure the replaceable ledger within the channel.

* * * * *